US011326242B2

(12) United States Patent
Ziegler et al.

(10) Patent No.: US 11,326,242 B2
(45) Date of Patent: May 10, 2022

(54) COPPER-NICKEL-TIN ALLOYS

(71) Applicant: Materion Corporation, Mayfield Heights, OH (US)

(72) Inventors: Karl R. Ziegler, Huron, OH (US); John E. Gatehouse, Sinking Spring, PA (US); Bruce D. Schmeck, Leesport, PA (US); Fritz C. Grensing, Perrysburg, OH (US)

(73) Assignee: Materion Corporation, Mayfield Heights, OH (US)

( * ) Notice: Subject to any disclaimer, the term of this patent is extended or adjusted under 35 U.S.C. 154(b) by 768 days.

(21) Appl. No.: 15/887,677

(22) Filed: Feb. 2, 2018

(65) Prior Publication Data

US 2018/0223407 A1 Aug. 9, 2018

Related U.S. Application Data

(60) Provisional application No. 62/454,791, filed on Feb. 4, 2017.

(51) Int. Cl.
*C22F 1/08* (2006.01)
*C22C 9/06* (2006.01)

(52) U.S. Cl.
CPC . *C22F 1/08* (2013.01); *C22C 9/06* (2013.01)

(58) Field of Classification Search
CPC ..... C22F 1/08; C22C 9/00; C22C 9/02; C22C 9/06
See application file for complete search history.

(56) References Cited

U.S. PATENT DOCUMENTS 6,471,792 B1 10/2002 Breedis
2007/0253858 A1* 11/2007 Ababneh ..... C22C 1/06 420/487
2007/0254180 A1* 11/2007 Ababneh ..... F16C 33/121 428/677
2009/0098011 A1 4/2009 Trybus et al.
2013/0333812 A1* 12/2013 Ishida ..... C22C 9/01 148/554
2014/0261924 A1 9/2014 Wetzel et al.
2016/0312340 A1* 10/2016 Uda ..... C22C 9/06
2016/0369374 A1* 12/2016 Maki ..... C22F 1/00

OTHER PUBLICATIONS

International Search Report for PCT Application No. PCT/US2018/016677 dated Mar. 22, 2018.

* cited by examiner

*Primary Examiner* — John A Hevey
(74) *Attorney, Agent, or Firm* — Cozen O'Connor

(57) ABSTRACT

Disclosed are various processes for preparing a strip or plate of a copper-nickel-tin alloy. The processes begin with an input, usually of a rectangular shape. The input is hot rolled and annealed. The input is then subjected to a first cold reduction, a first annealing a second cold reduction, a second annealing, a third cold reduction, and a third annealing. If desired, a fourth cold reduction, a fourth annealing, and a fifth cold reduction may be performed. The resulting strip or plate is very smooth and has increased fatigue life, along with high strength.

16 Claims, 10 Drawing Sheets

1350°F anneal

1300°F anneal

1400°F anneal

1425°F anneal

1550°F anneal

1450°F anneal

COPPER-NICKEL-TIN ALLOYS

CROSS-REFERENCE TO RELATED APPLICATIONS

This application claims priority to U.S. Provisional Patent Application Ser. No. 62/454,791, filed Feb. 4, 2017, the entirety of which is hereby fully incorporated by reference.

BACKGROUND

The present disclosure relates to improved copper-nickel-tin alloys, articles made from those alloys, and methods of making and using such articles.

Many copper-nickel-tin alloys have high strength, resilience and fatigue strength. Some can be spinodally hardened and engineered to produce additional characteristics such as high strength and hardness, galling resistance, stress relaxation, corrosion, and erosion. However, it is desirable to produce copper-nickel-tin alloys having further improved features.

BRIEF DESCRIPTION

The present disclosure relates to processes for improving the processing of copper-nickel-tin alloys, to produce alloys with enhanced characteristics.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
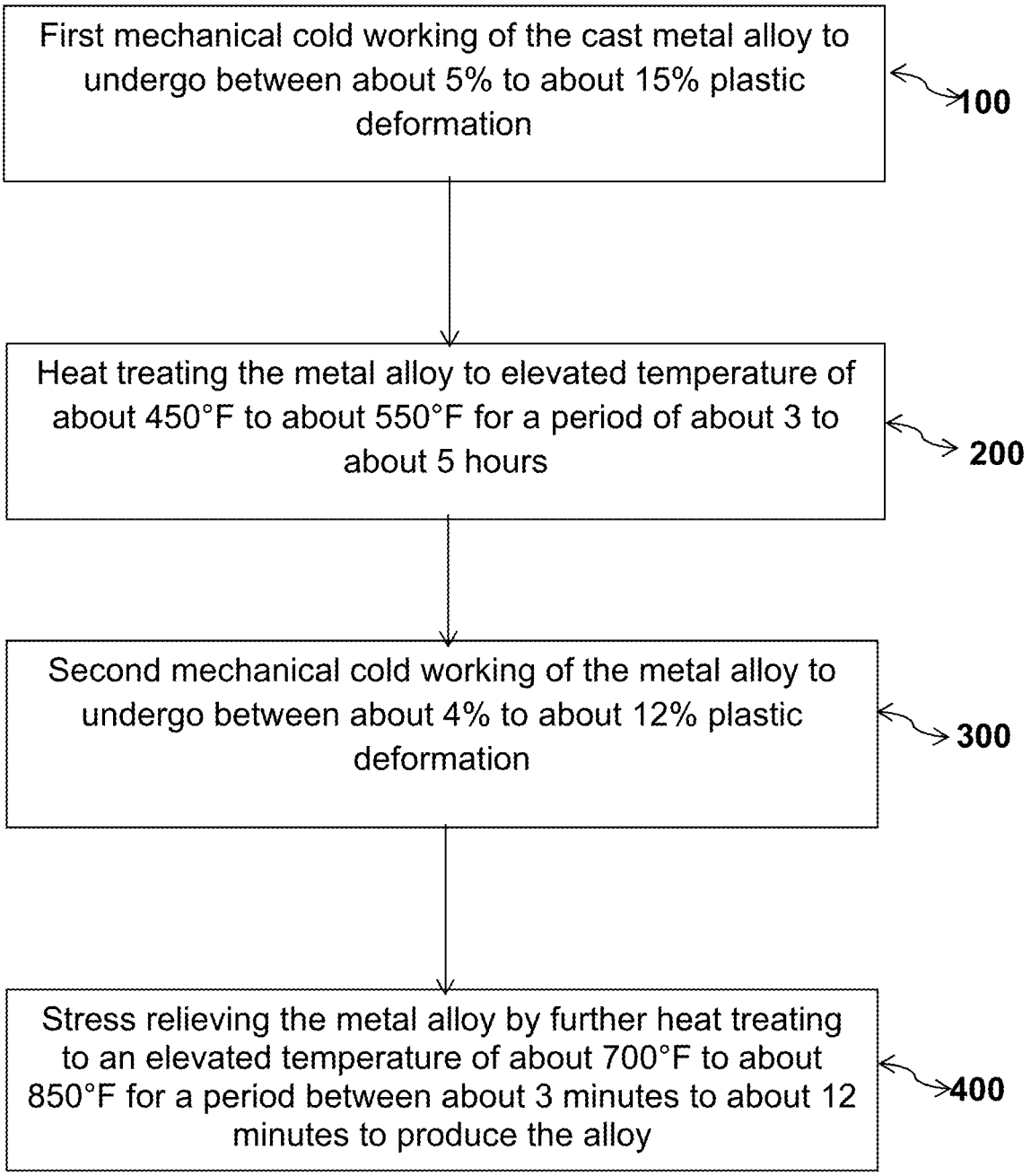
FIG. 1 is a flow chart illustrating an exemplary process of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number. However, for temperatures, the term "about" refers to plus or minus 50° F.

Percentages of elements should be assumed to be percent by weight of the stated alloy, unless expressly stated otherwise.

The present disclosure may refer to temperatures for certain process steps. It is noted that these generally refer to the temperature at which the heat source (e.g. furnace) is set, and do not necessarily refer to the temperature which must be attained by the material being exposed to the heat.

As used herein, the term "spinodal alloy" refers to an alloy whose chemical composition is such that it is capable of undergoing spinodal decomposition. The term "spinodal alloy" refers to alloy chemistry, not physical state. Therefore, a "spinodal alloy" may or may not have undergone spinodal decomposition and may or not be in the process of undergoing spinodal decomposition.

Spinodal aging/decomposition is a mechanism by which multiple components can separate into distinct regions or microstructures with different chemical compositions and physical properties. In particular, crystals with bulk composition in the central region of a phase diagram undergo exsolution. Spinodal decomposition at the surfaces of the alloys of the present disclosure results in surface hardening.

Spinodal alloy structures are made of homogeneous two phase mixtures that are produced when the original phases are separated under certain temperatures and compositions referred to as a miscibility gap that is reached at an elevated temperature. The alloy phases spontaneously decompose into other phases in which a crystal structure remains the same but the atoms within the structure are modified but remain similar in size. Spinodal hardening increases the yield strength of the base metal and includes a high degree of uniformity of composition and microstructure.

Some copper-nickel-tin alloys that can be used in the present disclosure can be those with improved properties, such as those described in U.S. Pat. Nos. 9,518,315 and 9,487,850, which are each completely incorporated by reference herein.

The copper-nickel-tin-containing alloys, in particular embodiments, contain nickel, tin, and balance copper, with other elements being considered unavoidable impurities. The nickel may be present in an amount of from about 8 wt % to about 16 wt %. In more specific embodiments, the nickel is present in amounts of about 14 wt % to about 16 wt %, or about 8 wt % to about 10 wt %. The tin may be present in an amount of from about 5 wt % to about 9 wt %. In more specific embodiments, the tin is present in amounts of about 7 wt % to about 9 wt %, or about 5 wt % to about 7 wt %. The balance of the alloy is copper. Thus, the copper can be present in an amount of about 75 wt % to about 87 wt %, or about 75 wt % to about 79 wt %, or about 83 wt % to about 87 wt %. These listed amounts of copper, nickel, and tin may be combined with each other in any combination.

In some specific embodiments, the copper-nickel-tin-containing alloy contains from about 8 wt % to about 16 wt % nickel, about 5 wt % to about 9 wt % tin, and balance copper. In more specific embodiments, the copper-nickel-tin-containing alloy contains from about 14 wt % to about 16 wt % nickel, about 7 wt % to about 9 wt % tin, and balance copper. In other specific embodiments, the copper-nickel-tin-containing alloy contains from about 8 wt % to about 10 wt % nickel, about 5 wt % to about 7 wt % tin, and balance copper. Some of the copper-nickel-tin alloys utilized herein generally include from about 9.0 wt % to about 15.5 wt % nickel, and from about 6.0 wt % to about 9.0 wt % tin, with the remaining balance being copper. More particularly, the copper-nickel-tin alloys of the present disclosure include from about 9 wt % to about 15 wt % nickel and from about 6 wt % to about 9 wt % tin, with the remaining balance being copper. In more specific embodiments, the copper-nickel-tin alloys include from about 14.5 wt % to about 15.5% nickel, and from about 7.5 wt % to about 8.5 wt % tin, with the remaining balance being copper.

These alloys can have a combination of various properties that separate the alloys into different ranges. More specifically, "TM04" refers to copper-nickel-tin alloys that generally have a 0.2% offset yield strength of 105 ksi to 125 ksi, an ultimate tensile strength of 115 ksi to 135 ksi, and a Vickers Pyramid Number (HV) of 245 to 345. To be considered a TM04 alloy, the yield strength of the alloy must be a minimum of 115 ksi. "TM06" refers to copper-nickel-tin alloys that generally have a 0.2% offset yield strength of 120 ksi to 145 ksi, an ultimate tensile strength of 130 ksi to 150 ksi, and a Vickers Pyramid Number (HV) of 270 to 370. To be considered a TM06 alloy, the yield strength of the alloy must be a minimum of 130 ksi. "TM12" refers to copper-nickel-tin alloys that generally have a 0.2% offset yield strength of at least 175 ksi, an ultimate tensile strength of at least 180 ksi, and a minimum % elongation at break of 1%. To be considered a TM12 alloy, the yield strength of the alloy must be a minimum of 175 ksi.

Generally, these alloys can be formed by the combination of solid copper, nickel, and tin in the desired proportions. The preparation of a properly proportioned batch of copper, nickel, and tin is followed by melting to form the alloy. Alternatively, nickel and tin particles can be added to a molten copper bath. The melting may be carried out in a gas-fired, electrical induction, resistance, or arc furnace of a size matched to the desired solidified product configuration. Typically, the melting temperature is at least about 2057° F. (1125° C.) with a superheat dependent on the casting process and in the range of 150° F. to 500° F. (65° C. to 260° C.). An inert atmosphere (e.g., including argon and/or carbon dioxide/monoxide) and/or the use of insulating protective covers (e.g., vermiculite, alumina, and/or graphite) may be utilized to maintain neutral or reducing conditions to protect oxidizable elements.

The alloys of the present disclosure can be used in conductive spring applications such as electronic connectors, switches, sensors, electromagnetic shielding gaskets, and voice coil motor contacts. They can be provided in a pre-heat treated (mill hardened) form or a heat treatable (age hardenable) form. Additionally, the disclosed alloys do not contain beryllium and thus can be utilized in applications which beryllium is not desirable.

Figure 2:
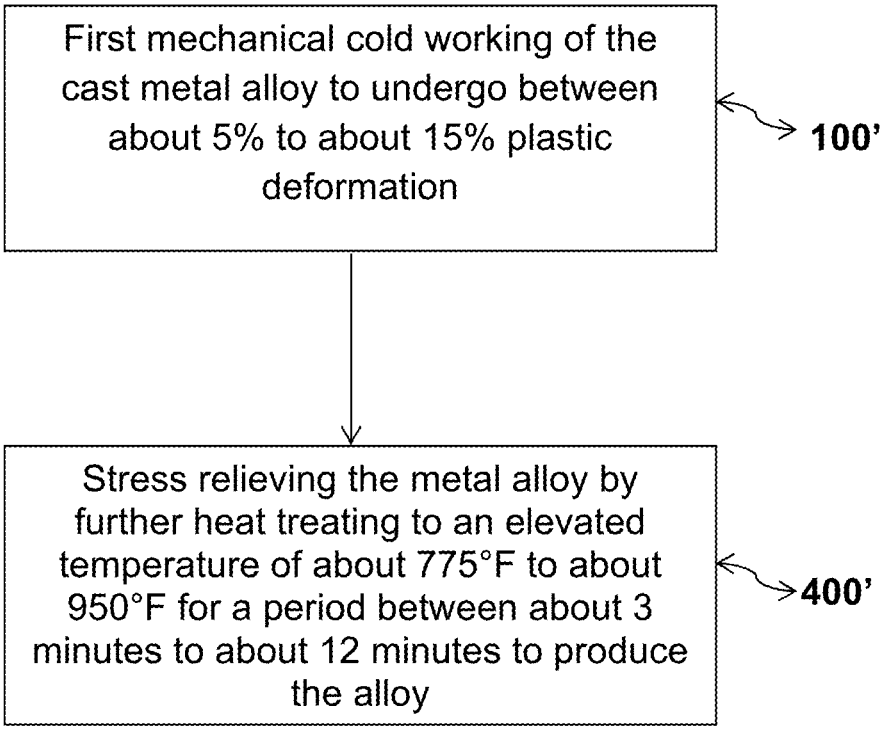
FIG. 2 is a flow chart illustrating a further exemplary process of the present disclosure.

FIG. 1 and FIG. 2 illustrate processes described in U.S. Pat. No. 9,518,315. FIG. 1 illustrates a flowchart for working a TM04 rated copper-nickel-tin alloy to obtain desired properties. It is particularly contemplated that these processes are applied to such TM04 rated alloys. The process begins by first cold working the alloy 100.

Cold working is the process of mechanically altering the shape or size of the metal by plastic deformation. This can be done by rolling, drawing, pressing, spinning, extruding or heading of the metal or alloy. When a metal is plastically deformed, dislocations of atoms occur within the material. Particularly, the dislocations occur across or within the grains of the metal. The dislocations over-lap each other and the dislocation density within the material increases. The increase in over-lapping dislocations makes the movement of further dislocations more difficult. This increases the hardness and tensile strength of the resulting alloy while generally reducing the ductility and impact characteristics of the alloy. Cold working also improves the surface finish of the alloy. Mechanical cold working is generally performed at a temperature below the recrystallization point of the alloy, and is usually done at room temperature. The percentage of cold working (% CW), or the degree of deformation, can be determined by measuring the change in the cross-sectional area of the alloy before and after cold working, according to the following formula:

$$\% CW = 100*[A_0 - A_f]/A_0$$

where $A_0$ is the initial or original cross-sectional area before cold working, and $A_f$ is the final cross-sectional area after cold working. It is noted that the change in cross-sectional area is usually due solely to changes in the thickness of the alloy, so the % CW can also be calculated using the initial and final thickness as well.

In embodiments, the initial cold working 100 is performed so that the resulting alloy has a % CW in the range of about 5% to about 15%. More particularly, the % CW of this first step can be about 10%.

Next, the alloy undergoes a heat treatment 200. Heat treating of metal or alloys is a controlled process of heating and cooling metals to alter their physical and mechanical properties without changing the product shape. Heat treatment is associated with increasing the strength of the material, but it can also be used to alter certain manufacturability objectives such as to improve machining, improve formability, or to restore ductility after a cold working operation. The initial heat treating step 200 is performed on the alloy after the initial cold working step 100. The alloy is placed in a traditional furnace or other similar assembly and then exposed to an elevated temperature in the range of about 450° F. to about 550° F. for a time period of from about 3 hours to about 5 hours. In more specific embodiments, the alloy is exposed to an elevated temperature of about 525° F. for a duration of about 4 hours. It is noted that these temperatures refer to the temperature of the atmosphere to which the alloy is exposed, or to which the furnace is set; the alloy itself does not necessarily reach these temperatures.

After the heat treatment step 200, the resulting alloy material undergoes a second cold working or planish step 300. More particularly, the alloy is mechanically cold worked again to obtain a % CW in the range of about 4% to about 12%. More particularly, the % CW of this first step can be about 8%. It is noted that the "initial" cross-sectional area or thickness used to determine the % CW is measured after the heat treatment and before this second cold working begins. Put another way, the initial cross-sectional area/thickness used to determine this second % CW is not the original area/thickness before the first cold working step 100.

The alloy then undergoes a thermal stress relieving treatment to achieve the desired formability properties 400 after the second cold working step 300. In embodiments, the alloy is exposed to an elevated temperature in the range of from about 700° F. to about 850° F. for a time period of from about 3 minutes to about 12 minutes. More particularly, the elevated temperature is about 750° F. and the time period is about 11 minutes. Again, these temperatures refer to the temperature of the atmosphere to which the alloy is exposed, or to which the furnace is set; the alloy itself does not necessarily reach these temperatures.

After undergoing the process described above, the TM04 copper-nickel-tin alloy will exhibit a formability ratio that is below 1 in the transverse direction and a formability ratio that is below 1 in the longitudinal direction. The formability ratio is usually measured by the R/t ratio. This specifies the minimum inside radius of curvature (R) that is needed to form a 90° bend in a strip of thickness (t) without failure, i.e. the formability ratio is equal to R/t. Materials with good formability have a low formability ratio (i.e. low R/t). The formability ratio can be measured using the 90° V-block test, wherein a punch with a given radii of curvature is used to force a test strip into a 90° die, and then the outer radius of the bend is inspected for cracks. In addition, the alloy will have a 0.2% offset yield strength of at least 115 ksi.

The longitudinal direction and the transverse direction can be defined in terms of a roll of the metal material. When a strip is unrolled, the longitudinal direction corresponds to the direction in which the strip is unrolled, or put another way is along the length of the strip. The transverse direction corresponds to the width of the strip, or the axis around which the strip is unrolled.

FIG. 2 illustrates a flowchart for working a TM06 rated copper-nickel-tin alloy to obtain desired properties. It is particularly contemplated that these processes are applied to such TM06 rated alloys. The process begins by first cold working the alloy 100'. In this embodiment, the initial cold working step 100' is performed so that the resulting alloy has a % CW in the range of about 5% to about 15%. More particularly, the % CW is about 10%.

Next, the alloy then undergoes a heat treatment 400'. This is similar to the thermal stress relief step applied to the TM04 alloy at 400'. In embodiments, the alloy is exposed to an elevated temperature in the range of from about 775° F. to about 950° F. for a time period of from about 3 minutes to about 12 minutes. More particularly, the elevated temperature is about 850° F.

Compared to the metal process for the TM04 rated tempered alloy, the resulting TM06 alloy material does not undergo a heat treatment step (i.e. 200 in FIG. 1) or a second cold working process/planish step (i.e. 300 in FIG. 1).

After undergoing the process described above, the TM06 copper-nickel-tin alloy will exhibit a formability ratio that is below 2 in the transverse direction and a formability ratio that is below 2.5 in the longitudinal direction. In more specific embodiments, the TM06 copper-nickel-tin alloy will exhibit a formability ratio that is below 1.5 in the transverse direction and a formability ratio that is below 2 in the longitudinal direction. Additionally, the copper-nickel-tin alloy will have a yield strength of at least 130 ksi, and more desirably a yield strength of at least 135 ksi.

A formability ratio that is below 2 in the transverse direction and a formability ratio that is below 2.5 in the longitudinal direction can be obtained at % CW of 20% to 35%. A formability ratio that is below 1.5 in the transverse direction and a formability ratio that is below 2 in the longitudinal direction can be obtained at % CW of 25% to 30%.

A balance is reached between cold working and heat treating in the processes disclosed herein. There is an ideal balance between the amount of strength and the formability ratio that is gained from cold working and heat treatment.

Figure 3:
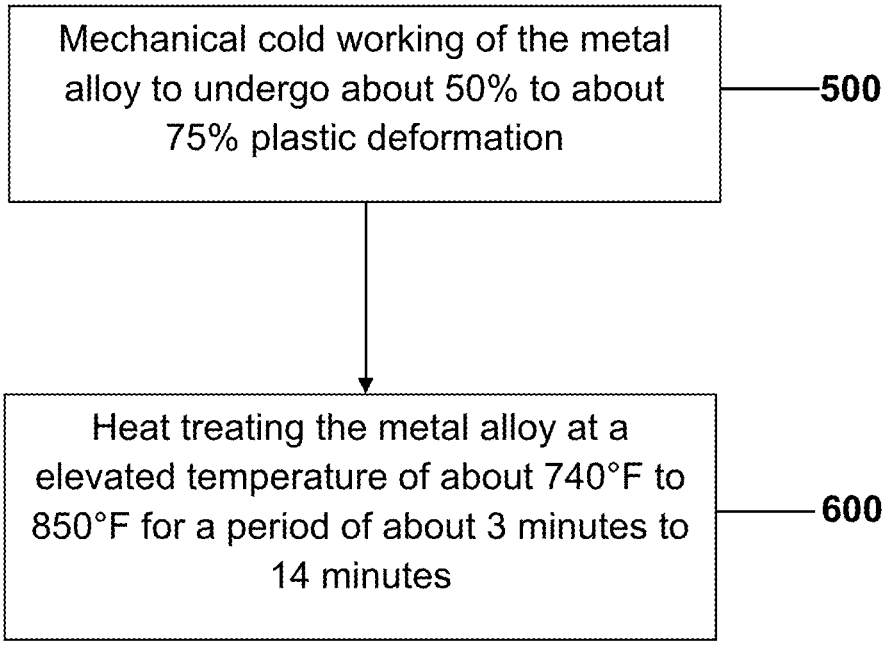
FIG. 3 is a flow chart illustrating a further exemplary process of the present disclosure.
Figure 5:
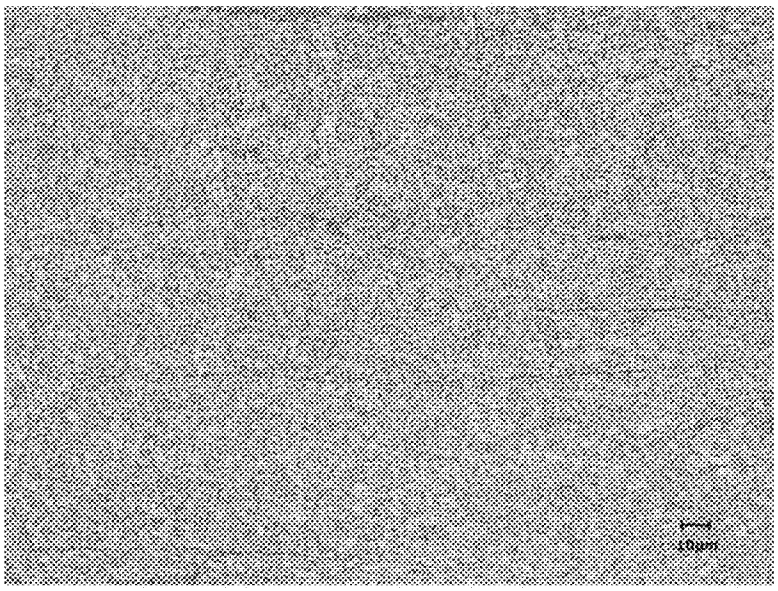
FIG. 5 is a picture showing the grain structure at 1350° F. anneal, 500× magnification.
Figure 4:
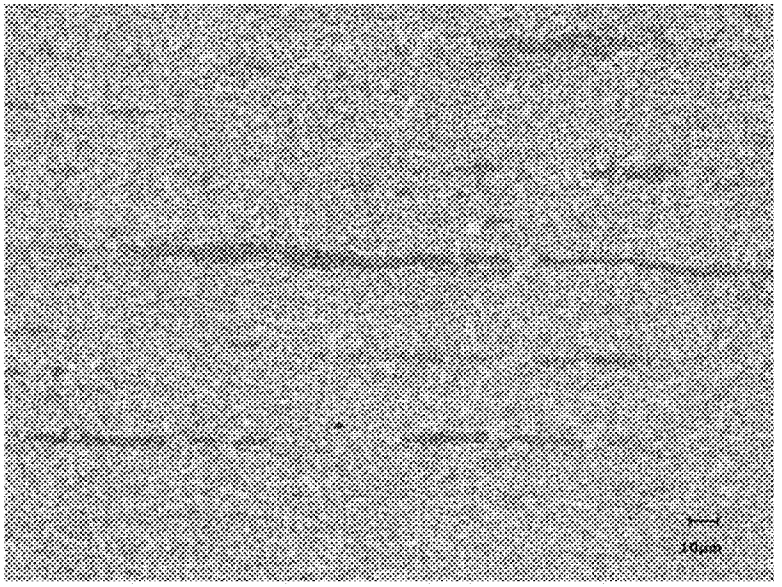
FIG. 4 is a picture showing the grain structure at 1300° F. anneal, 500× magnification.
Figure 6:
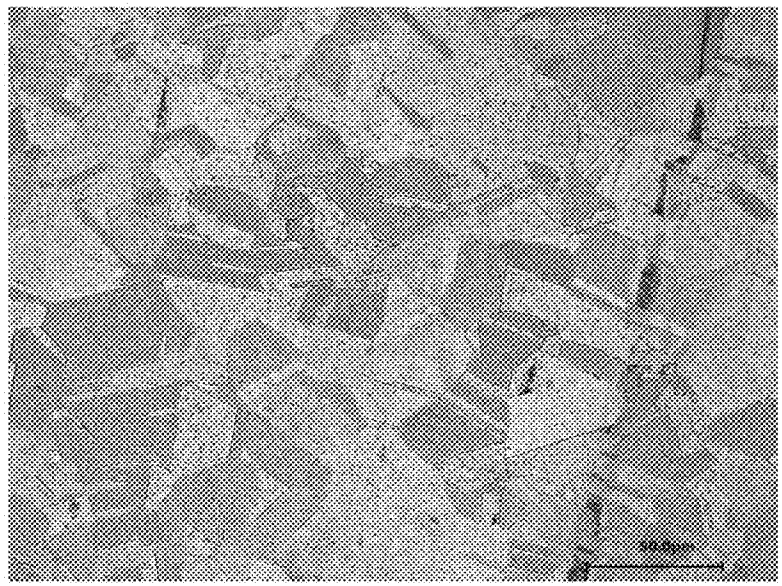
FIG. 6 is a picture showing the grain structure at 1400° F. anneal, 500× magnification.
Figure 7:
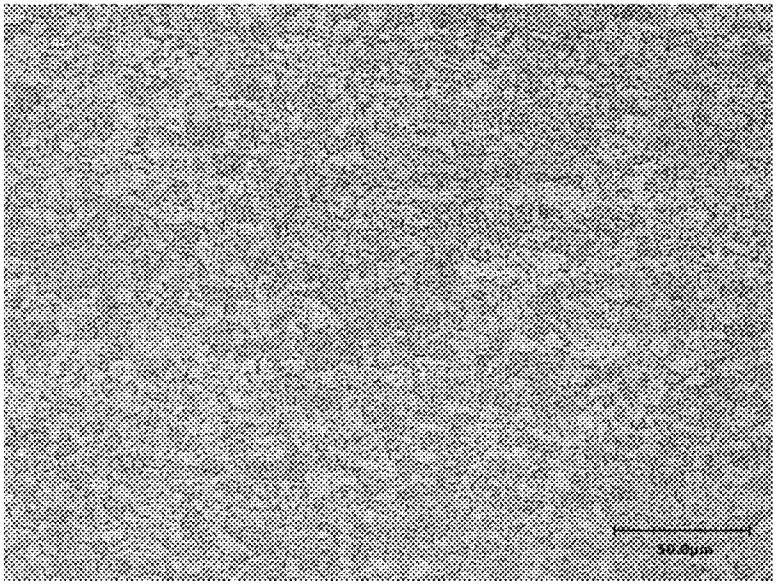
FIG. 7 is a picture showing the grain structure at 1425° F. anneal, 500× magnification.
Figure 9:
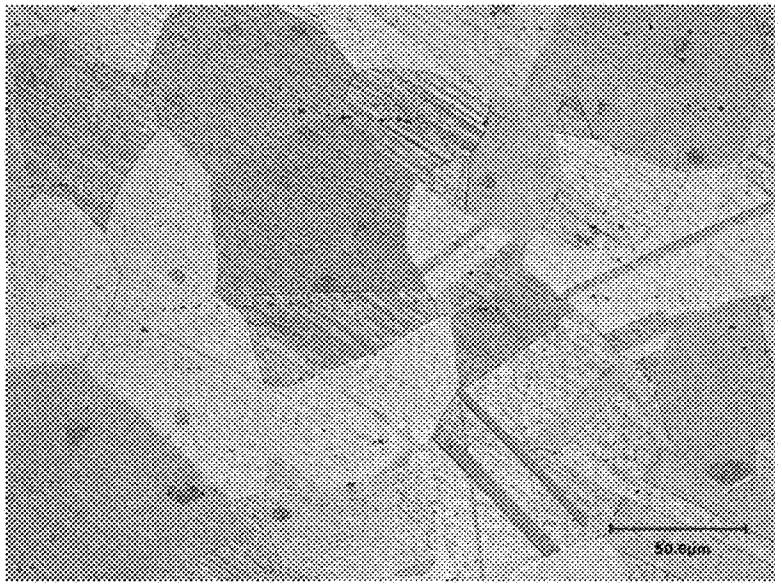
FIG. 9 is a picture showing the grain structure at 1550° F. anneal, 500× magnification.
Figure 8:
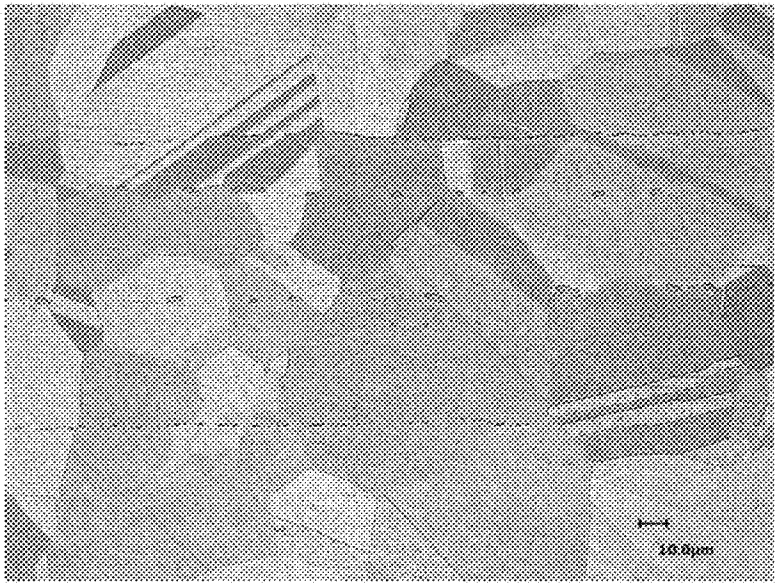
FIG. 8 is a picture showing the grain structure at 1450° F. anneal, 500× magnification.

FIG. 3 illustrates processes described in U.S. Pat. No. 9,487,850. FIG. 3 is a flowchart that outlines steps for obtaining a TM12 alloy. The metal working process begins by first cold working the alloy 500. The alloy then undergoes a heat treatment 600.

The initial cold working step 500 is performed on the alloy such that the resultant alloy has a plastic deformation in a range of 50%-75% cold working. More particularly, the cold working % achieved by the first step can be about 65%.

The alloy then undergoes a heat treatment step 600. Heat treating metal or alloys is a controlled process of heating and cooling metals to alter their physical and mechanical properties without changing the product shape. Heat treatment is associated with increasing the strength of the material but it can also be used to alter certain manufacturability objectives such as to improve machining, improve formability, or to restore ductility after a cold working operation. The heat treating step 600 is performed on the alloy after the cold working step 500. The alloy is placed in a traditional furnace or other similar assembly and then exposed to an elevated temperature in the range of about 740° F. to about 850° F. for a time period of from about 3 minutes to about 14 minutes. It is noted that these temperatures refer to the temperature of the atmosphere to which the alloy is exposed, or to which the furnace is set; the alloy itself does not necessarily reach these temperatures. This heat treatment can be performed, for example, by placing the alloy in strip form on a conveyor furnace apparatus and running the alloy strip at a rate of about 5 ft/min through the conveyor furnace. In more specific embodiments, the temperature is from about 740° F. to about 800° F.

This process can achieve a yield strength level for the ultra high strength copper-nickel-tin alloy that is at least 175 ksi. This process has consistently been identified to produce alloy having a yield strength in the range of about 175 ksi to 190 ksi. More particularly, this process can process alloy with a resulting yield strength (0.2% offset) of about 178 ksi to 185 ksi.

A balance is reached between cold working and heat treating. There is an ideal balance between an amount of strength that is gained from cold working wherein too much cold working can adversely affect the formability characteristics of this alloy. Similarly, if too much strength gain is derived from heat treatment, formability characteristics can be adversely affected. The resulting characteristics of the TM12 alloy include a yield strength that is at least 175 ksi. This strength characteristic exceeds the strength features of other known similar copper-nickel-tin alloys.

The copper-nickel-tin alloys can be processed to form a strip. Strip is recognized in the art as a flat surfaced product of generally rectangular cross-section with the two sides being straight and having a uniform thickness of up to 4.8 millimeters (mm). This is generally done by rolling an input to reduce its thickness to that of strip. It is believed the alloys can also be processed in plate form. Plate is recognized in the art as a flat surfaced product of generally rectangular cross-section with the two sides being straight and having a uniform thickness greater than 4.8 millimeters (mm), and with a maximum thickness of about 210 mm.

Very generally, (1) the alloy is cast to form a billet; (2) the billet is homogenized; (3) the billet is cropped to obtain an input; and (4) the input is then rolled to obtain the strip of a desired thickness.

The grain structure of the alloy will affect the fatigue life. In the art, lower anneal temperatures are known to develop small and consistent grain structures. On the other hand, higher anneal temperatures are needed to dissolve strengthening phases and maximize strength after aging heat treatments. The processes of the present disclosure use alternating sequences of mechanical deformation with thermal treatment to obtain an optimized combination of grain structure and property specifications.

Generally, the processes of the present begin with the copper-nickel-tin alloy in the form of an input (which can be rectangular, circular, etc). The input is subjected to at least a first cold reduction, a first annealing, a second cold reduction, a second annealing, a third cold reduction, a third annealing, and a final cold reduction.

It is contemplated that in some embodiments, a fourth cold reduction and a fourth annealing occur between the third annealing and the final cold reduction. It is also contemplated that prior to the first cold reduction, the input may also be subjected to hot rolling and an initial annealing.

All of the cold reduction steps can be performed by cold rolling, stretch leveling, or stretch bend leveling. Again, cold reduction reduces the thickness of the input, and is generally performed at a temperature below the recrystallization point of the alloy (usually at room temperature).

The first cold reduction step is performed to achieve a thickness reduction of about 10% to about 80%. The second, third, and fourth cold reduction steps are performed to achieve a thickness reduction of about 40% to about 60%.

In cold rolling, the input is passed between rolls to obtain a reduction in thickness of the input. In stretch leveling, the workpiece is stretched beyond its yield point to equalize the stresses. This can be done, for example, using a pair of entry and exit frames. Each frame grips the workpiece across its width, and the two frames are pushed away from each other. This exceeds the yield strength of the workpiece, and the input is subsequently stretched in the direction of travel. In stretch bend leveling, the workpiece is bent progressively up and down over rolls of sufficient diameter to stretch the outer and inner surfaces of the workpieces past the yield point, to equalize the stresses.

The various annealing steps are performed at different temperatures. The initial annealing may be performed at a temperature of about 1525° F. to about 1575° F. The first annealing may be performed at a temperature of about 1400° F. to about 1450° F. The second annealing may be performed at a temperature of about 1400° F. to about 1450° F. The third annealing may be performed at a temperature of about 1375° F. to about 1425° F. The fourth annealing may be performed at a temperature of about 1375° F. to about 1425° F. The annealing steps performed after cold reduction occur at temperatures of 1500° F. or below.

As mentioned, hot working may be performed upon the input before the cold reduction and annealing steps. Hot working is a metal forming process in which an alloy is passed through rolls, dies, or is forged to reduce the section of the alloy and to make the desired shape and dimension, at a temperature generally above the recrystallization temperature of the alloy. This generally reduces directionality in mechanical properties, and produces a new equiaxed microstructure. The degree of hot working performed is indicated in terms of % reduction in thickness. The hot working may be performed to achieve a thickness reduction of about 40% to about 60%.

Generally, the processes of the present disclosure include more frequent anneals at intermediate points in the rolling processes. In addition, the anneal temperatures are lower than standard annealing. In conventional processes, the input is rolled to about 85% reduction in thickness, then annealed. The more frequent anneals and smaller reductions in thickness are expected to recrystallize the grain structure, and thus reduce surface tearing in later rollings.

The resulting alloys have, in particular embodiments, a Vickers Hardness (HV) of 250 or greater, including from 250 to about 470. The alloy/strip can have a fatigue life of greater than 400,000 cycles at a maximum stress of 65 ksi (tested in the longitudinal direction). The strip may have an Sz of 75 micro-inches or less at a thickness of 0.0072 Angstroms, when measured according to ISO 25178. The strip may have an Sv of 45 micro-inches or less at a thickness of 0.0072 Angstroms, when measured according to ISO 25178. The strip may have an Sdr of 0.01 or less at a thickness of 0.0072 Angstroms, when measured according to ISO 25178. Combinations of these properties are also contemplated.

The following examples are provided to illustrate the alloys, processes, articles, and properties of the present disclosure. The examples are merely illustrative and are not intended to limit the disclosure to the materials, conditions, or process parameters set forth therein.

EXAMPLES

Initially, strips of Cu—Ni15-Sn8 alloy with a thickness of 0.075 inches were annealed at various temperatures (1300° F., 1350° F., 1400° F., 1425° F., 1450° F., and 1550° F.). FIGS. 4-9 are pictures showing the grain structure of the strip after annealing at these temperatures.

Next, a comparison of the following two processes is made:

| Comparative Process | Example Process |
|---|---|
| Forged rectangle input | Forged rectangle input |
| Preheat to 1490° F. | Preheat to 1490° F. |
| Hot roll to 0.550 inches | Hot roll to 0.550 inches |
| Water quench | Water quench |
| Anneal at 1500° F. | Anneal at 1550° F. |
| Water quench | Water quench |
| Slab mill for cutting | Slab mill for cutting |
| | Cold roll to 0.150 inches (72%) |
| | Anneal at 1450° F. |
| | Water quench |
| Cold roll to 0.075 inches (86%) | Cold roll to 0.075 inches (50%) |
| Anneal at 1550° F. | Anneal at 1450° F. |
| | Cold roll to 0.038 inches (50%) |
| | Anneal at 1425° F. |
| Cold roll to 0.015 inches (80%) | Cold roll to 0.015 inches (60%) |
| Anneal at 1550° F. | Anneal at 1425° F. |
| Cold roll to 0.0072 inches (50%) | Cold roll to 0.0072 inches (50%) |

Figure 10:
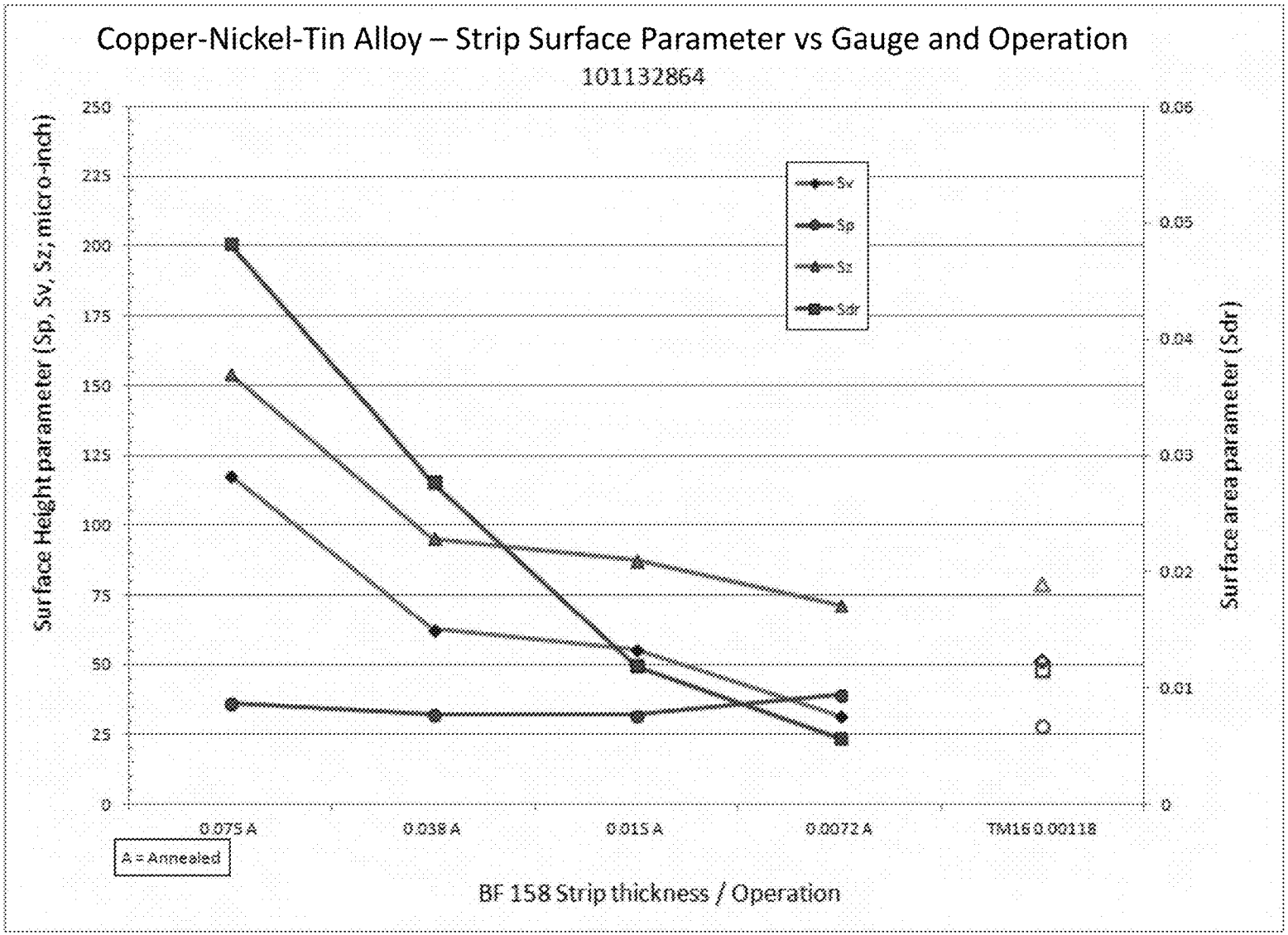
FIG. 10 is a bar graph showing the surface height parameter (micro-inches) versus the strip thickness (inches). The left-hand y-axis runs from 0 to 250 at intervals of 25. The x-axis is for thickness of 0.075 inches, 0.038 inches, 0.015 inches, 0.0072 inches, and 0.00118 inches. The 0.00118 inches is for a conventional process. The Sv parameter is in diamonds, the Sp parameter is in circles, the Sz parameter is in triangles, and the Sdr parameter is in squares. The right-hand y-axis runs from 0 to 0.06 at intervals of 0.01, and is unitless, and is for Sdr only.

FIG. 10 is a graph showing the changes in surface height parameter according to ISO 25178. The Example Process was compared to historical data for the Comparative Process at 0.00118 inches thickness (right-most column). Four parameters (Sv, Sp, Sz, and Sdr) are graphed at different thicknesses. Lower values for each parameter indicate a smoother surface with fewer peaks or pits. The Sp (max peak height) parameter is essentially constant as the strip is processed, meaning the surface improvement is from a reduction in the valleys in the surface. All of these inconsistencies can cause lower fatigue life. The Sz value at 0.0072 inches is better than for the 0.00118 inch thickness of the historical data, indicating the smoothness of the strip with the processes of the present disclosure (i.e. can get a better smoothness at almost six times the thickness).

Figure 11:
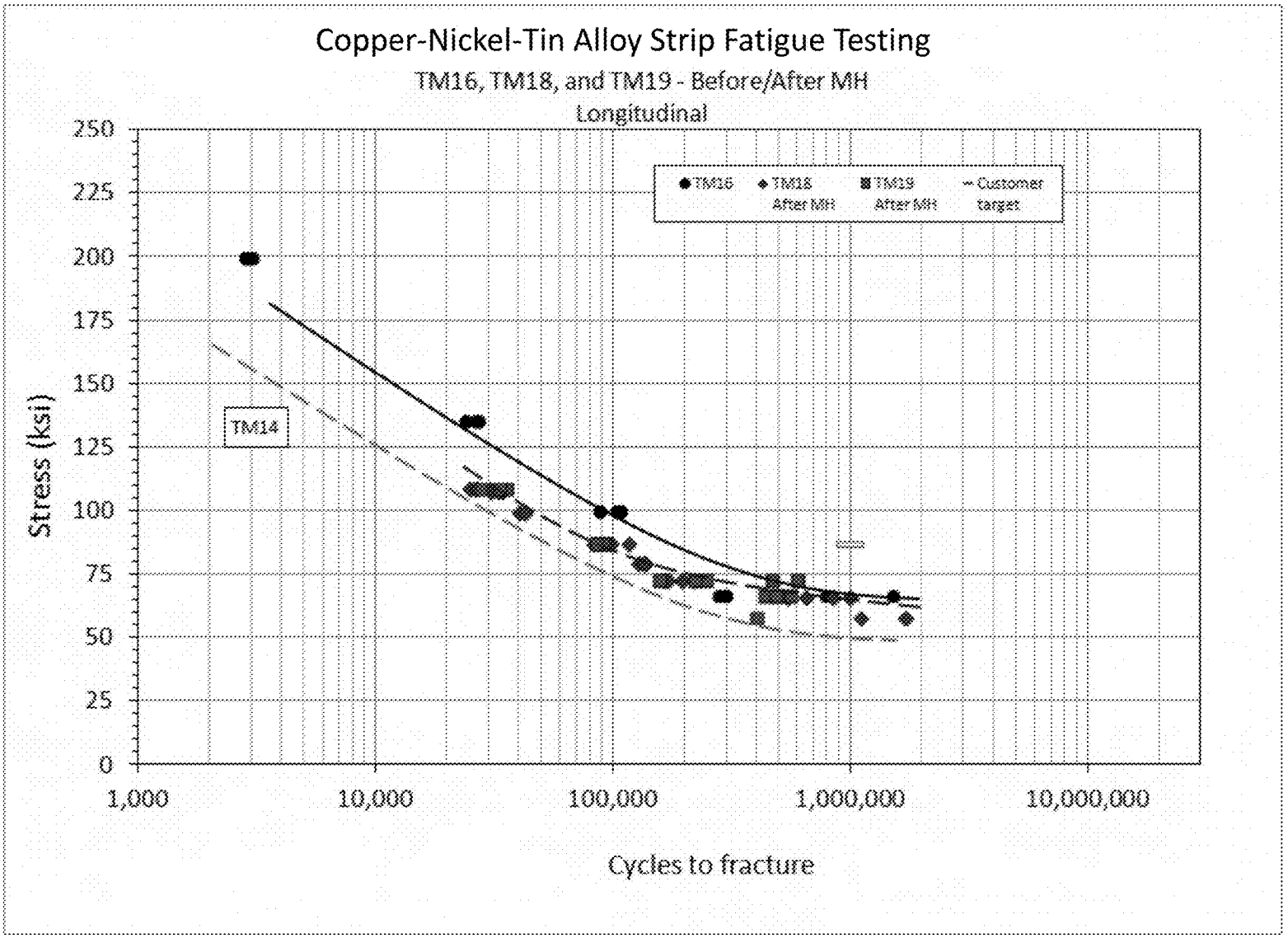
FIG. 11 is a lin-log graph of stress (ksi, linear) versus cycles to fracture (logarithmic). The y-axis runs from 0 to 250 at intervals of 25. The x-axis runs from 1,000 to 10,000,000.
Figure 12:
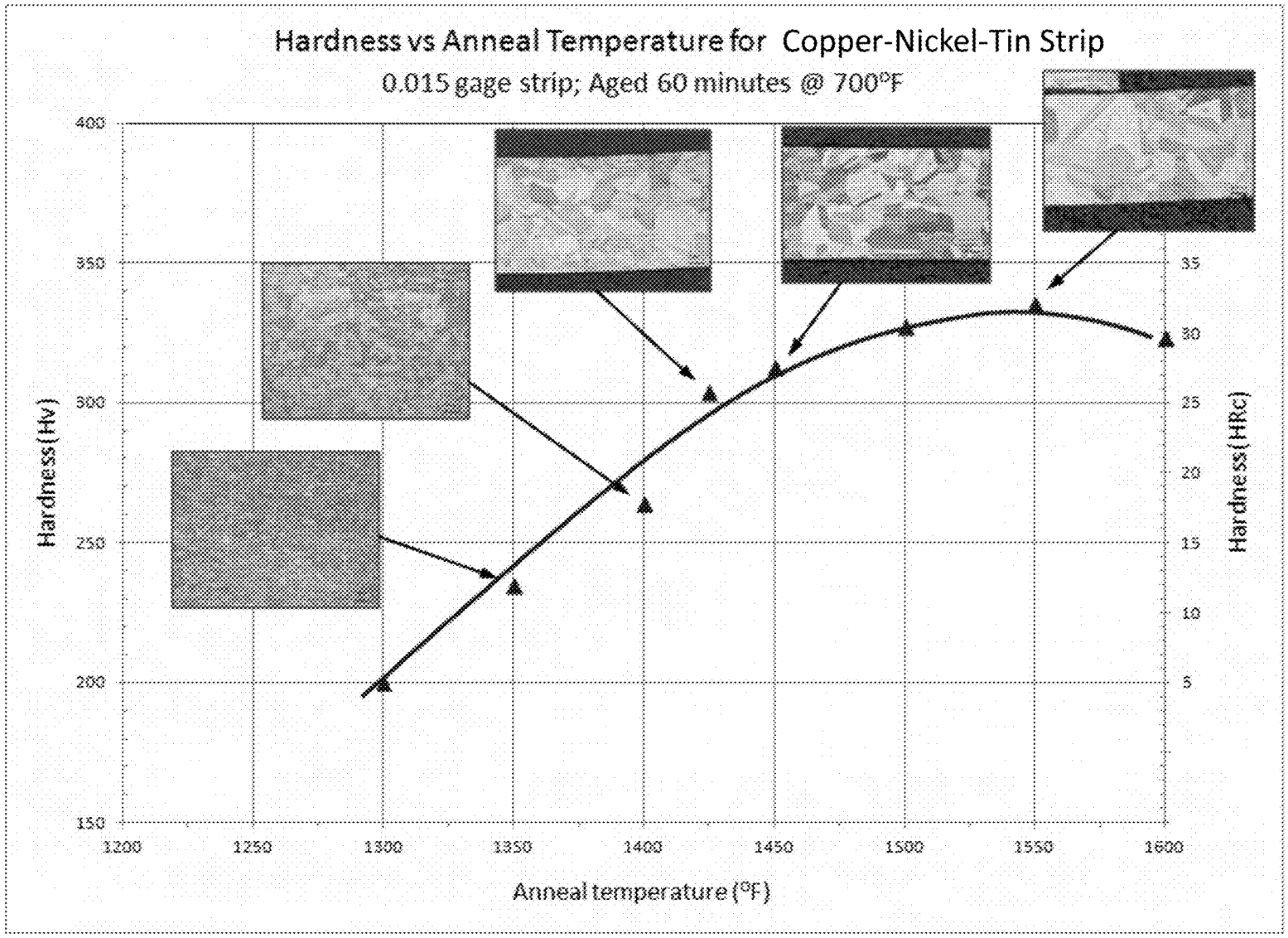
FIG. 12 is a graph of Vickers hardness (HV) versus annealing temperature (° F.). The y-axis runs from 150 to 400 at intervals of 50. The x-axis runs from 1200° F. to 1600° F. at intervals of 50° F.

Fatigue testing is shown in FIG. 11. TM16 is the Comparative Process, while TM19 indicates the Example Process. TM19 alloys have a 0.2% offset yield strength of Finally, samples of the strip of the Example process were taken after each annealing step and then aged to check its "heat treatment response". This indicates how well the strengthening phase was dissolved during the annealing process. The more of the strengthening phase that was dissolved (higher anneal temperature), the higher the material strength and ductility after aging. FIG. 12 shows the conflict between desired results—at lower anneal temperatures, the grain structure is finer and more consistent; however, a better hardness is reached after aging with a higher anneal temperature.

Figure 13:
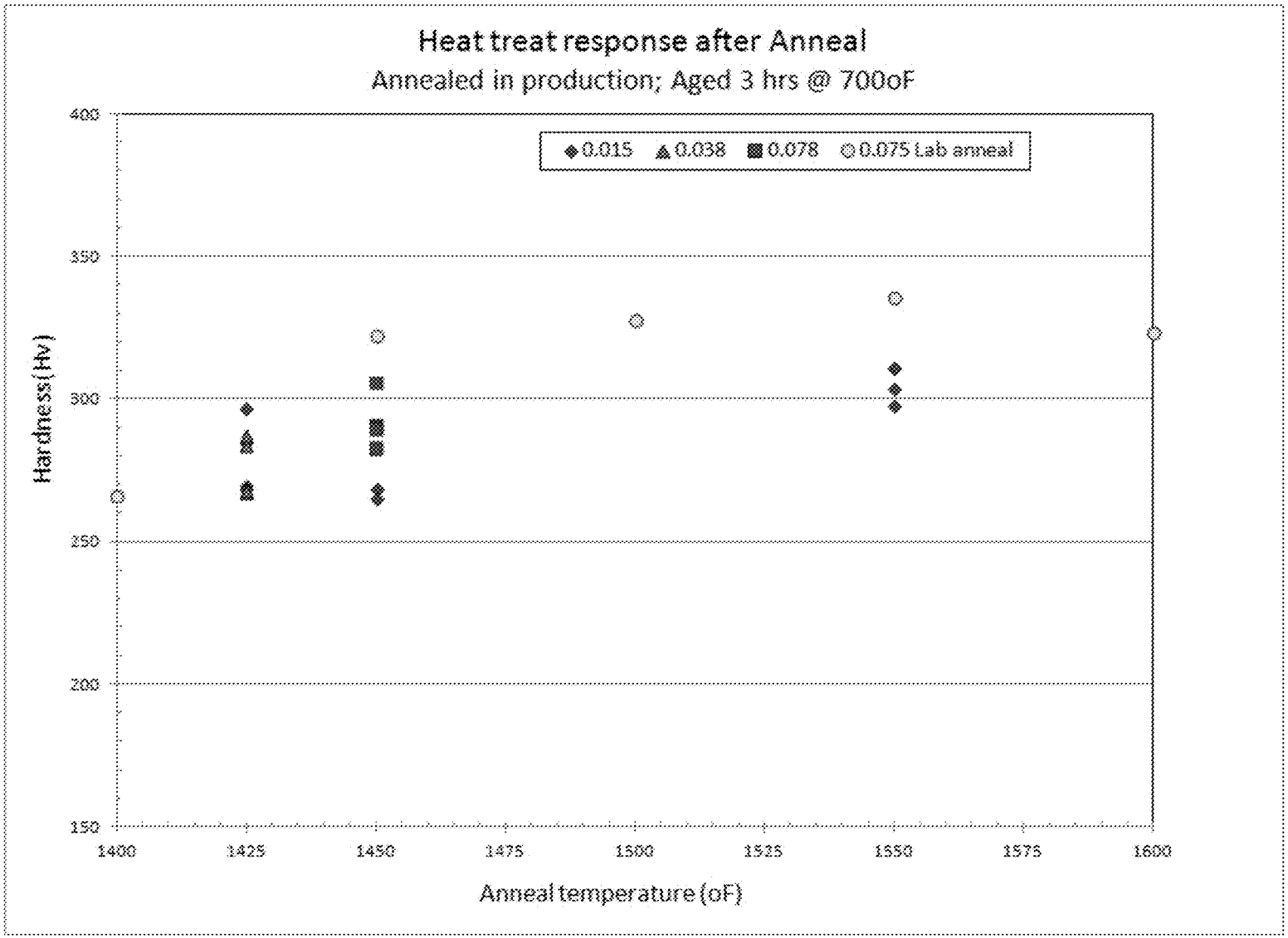
FIG. 13 is a graph of Vickers hardness (HV) versus annealing temperature (° F.) for four different thicknesses after annealing and subsequent aging for three hours at 700° F. The y-axis runs from 150 to 400 at intervals of 50. The x-axis runs from 1400° F. to 1600° F. at intervals of 25° F.

FIG. 13 shows another comparison between lab anneal and production anneal. The hardness is measured after aging for 3 hours at 700° F. In this graph, the hardness after aging is different for the Lab anneal (circles) and the Production anneal (diamonds for 0.015 inch thickness, triangles for 0.038 inch thickness, squares for 0.078 inch thickness). The differences indicate that in Production, the strip probably does not reach the set-point temperature for the anneal cycle, or the quench from the anneal temperature was delayed.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A process for preparing a strip or plate of a copper-nickel-tin-alloy, comprising:

a first cold reduction of an input made of the copper-nickel-tin-alloy, comprising copper, tin, at least about 8 wt % nickel, and optional unavoidable impurities, performed to achieve a thickness reduction of 10% to 80%;

a first annealing of the input performed at a temperature of 760° C. to 788° C. (1400° F. to 1450° F.);

a second cold reduction of the input performed to achieve a thickness reduction of 40% to 60%;

a second annealing of the input performed at a temperature of 760° C. to 788° C. (1400° F. to 1450° F.);

a third cold reduction of the input performed to achieve a thickness reduction of 40% to 60%;

a third annealing of the input performed at a temperature of 750° C. to 770° C. (1375° F. to 1425° F.); and a final cold reduction of the input to obtain the strip or plate, wherein the resulting strip or plate has an Sz of 75 micro-inches or less at a thickness of 0.0072 Angstroms, when measured according to ISO 25178.

2. The process of claim 1, wherein the resulting strip or plate has a fatigue life of greater than 400,000 cycles at a maximum stress of 65 ksi.

3. The process of claim 1, wherein the resulting strip or plate has an Sv of 45 micro-inches or less at a thickness of 0.0072 Angstroms, when measured according to ISO 25178, or wherein the resulting strip or plate has an Sdr of 0.01 or less at a thickness of 0.0072 Angstroms, when measured according to ISO 25178.

4. The process of claim 1, further comprising a fourth cold reduction of the input, and a fourth annealing of the input, which are performed after the third annealing and before the final cold reduction.

5. The process of claim 4, wherein the fourth cold reduction is performed to achieve a thickness reduction of about 40% to about 60%.

6. The process of claim 4, wherein the fourth annealing is performed at a temperature of about 1375° F. to about 1425° F.

7. The process of claim 1, further comprising:

hot rolling the input; and an initial annealing of the input after the hot rolling;

wherein the hot rolling and the initial annealing are performed prior to the first cold reduction.

8. The process of claim 7, wherein the hot working is performed to achieve a thickness reduction of about 40% to about 60%.

9. The process of claim 7, wherein the initial annealing is performed at a temperature of about 1525° F. to about 1575° F.

10. The strip or plate produced by the process of claim 1.

11. The strip or plate of claim 10, having a 0.2% offset yield strength of about 100 MPa to about 1500 MPa; or having an ultimate tensile strength of about 400 MPa to about 1550 MPa.

12. The strip or plate of claim 10, having a Vickers hardness (HV) of about 90 to about 470.

13. The strip or plate of claim 10, having an Sv of 45 micro-inches or less at a thickness of 0.0072 Angstroms, when measured according to ISO 25178; or having an Sdr of 0.01 or less at a thickness of 0.0072 Angstroms, when measured according to ISO 25178.

14. An article made from or comprising the strip or plate of claim 10.

15. A method of using the strip or plate of claim 10, comprising shaping the strip or plate to form an article.

16. The process of claim 1, wherein the copper-nickel-tin alloy consists of copper, tin, at least about 8 wt % nickel, and optional unavoidable impurities.

* * * * *